United States Patent [19]

Heim

[11] Patent Number: 4,570,114

[45] Date of Patent: Feb. 11, 1986

[54] INTEGRATED VOLTAGE REGULATOR

[75] Inventor: Barry B. Heim, Mesa, Ariz.

[73] Assignee: Motorola, Inc., Schaumburg, Ill.

[21] Appl. No.: 595,752

[22] Filed: Apr. 2, 1984

[51] Int. Cl.[4] ..... G05F 3/20

[52] U.S. Cl. ..... 323/313

[58] Field of Search ..... 323/313, 314, 315, 316

[56] References Cited

U.S. PATENT DOCUMENTS 4,490,670 12/1984 Wong ..... 323/313

FOREIGN PATENT DOCUMENTS 55-131822 10/1980 Japan ..... 323/313

*Primary Examiner*—Peter S. Wong

*Assistant Examiner*—Judson H. Jones

*Attorney, Agent, or Firm*—William E. Koch

[57] ABSTRACT

An integrated voltage regulator is provided that includes an NPN shunt transistor that improves regulation and reduces chip size. A regulator circuit is coupled between an output node and a second supply voltage terminal for biasing an output emitter follower transistor. A voltage divider is coupled between a first supply voltage terminal and the second supply voltage terminal and biases the NPN shunt transistor. The NPN shunt transistor is coupled between the output node and the second supply voltage terminal for shunting excess current from the output node as the voltage on the first supply voltage terminal increases.

3 Claims, 2 Drawing Figures

- PRIOR ART -

INTEGRATED VOLTAGE REGULATOR

BACKGROUND OF THE INVENTION

1. Field of the Invention

This invention relates generally to voltage regulators internal to integrated circuits and, more particularly, to an $nV_{BE}$ type voltage regulator having an NPN shunt transistor for providing improved regulation.

2. Background Art

The prior art is replete with various voltage regulator circuits for supplying substantially constant output DC regulated voltages. There are as many techniques for regulating the voltage output of these regulator circuits as there are applications for such regulators.

Known techniques for voltage regulation include bandgap regulators and simple diode strings, or variously refined versions of diode strings all known as $nV_{BE}$ regulators.

Bandgap voltage regulators vary widely in specific design but the basis of a bandgap regulator comprises a first diode having a cathode coupled to a negative power supply voltage terminal and an anode coupled to a first node. A plurality of NPN transistors have their bases coupled to the first node and their emitters coupled to the negative supply voltage terminal through a first resistor. The collectors of the plurality of NPN transistors are coupled to an output node through a second resistor. The first node is coupled to the output node through a third resistor. A second NPN transistor has its collector connected to the output node, its base connected to the collectors of the plurality of NPN transistors, and its emitter coupled to the negative supply voltage terminal. The output node is coupled to the positive supply voltage terminal through a fourth resistor.

The disadvantage of a bandgap regulator for internal voltage supply use is that the temperature coefficient of the output voltage is dependent upon the value of the output voltage. Additional circuitry must be added to achieve both the desired output voltage and the desired temperature coefficient, thereby increasing circuit complexity and chip area. Additionally, the output voltage of a bandgap is very sensitive to extraneous emitter resistance in the plurality of NPN transistors. Process variations can routinely cause the output voltage to be out of specification due to the mechanism of emitter resistance.

Diode string regulators generally comprise a plurality of diodes coupled in series between a first supply voltage terminal and a node. A resistor is coupled between the node and a second supply voltage terminal. The polarity of the supply voltage is such that the diodes are forward biased. The base of an output emitter follower transistor is connected to the node and the emitter provides the output. The output voltage of a diode string regulator or of any $nV_{BE}$ regulator varies with temperature as some multiple (n) times the variation of a diode voltage drop ($V_{BE}$) with temperature. This desirable characteristic known as $nV_{BE}$ temperature tracking permits cancellation of temperature effects within the circuitry that is driven by the $nV_{BE}$ regulator. The simplicity and $nV_{BE}$ tracking make the $nV_{BE}$ regulator an excellent choice for internal voltage regulators.

The disadvantage of a diode string regulator is inadequate voltage regulation with respect to the power supply voltage. Changes in supply voltage can cause large changes in current through the diode string, changing the diode voltage drop and thus the output voltage. Thirty to forty millivolts per volt is a typical regulation and is sufficient to cause excessive variation in chip power with supply voltage variation.

One previously known $nV_{BE}$ regulator comprises an NPN transistor having an emitter connected to a negative supply voltage terminal, and a collector coupled to an output node by a first resistor. The output node is coupled to a second supply voltage terminal by a second resistor. The base of the NPN transistor is coupled to the negative supply voltage terminal by a third resistor and is coupled to the output node by a fourth resistor. The voltage from the base to the emitter of the NPN transistor is the reference voltage, $V_{BE}$, of the regulator. The resistance of the fourth resistor is some number (n) times the resistance of the third resistor and so sets the value of the output voltage at $(n+1)V_{BE}$. The output node generally provides an output by driving an emitter follower transistor. A PNP transistor has an emitter connected to the output node, a collector connected to the negative supply voltage terminal, and a base connected to the collector of the NPN transistor. The PNP transistor is intended to clamp the current through the NPN transistor at a constant value over variations in supply voltage. Constant current through the NPN transistor implies a constant value of $V_{BE}$ and thus a constant regulator output voltage.

However, the type of PNP transistor compatible with modern digital bipolar processing requires a large area on the chip and has a low beta. As a consequence of the low beta, the PNP transistor has a very high base current which flows into the collector of the NPN transistor. Thus a large portion of current variation that is intended to be shunted around the NPN transistor actually still flows through the NPN transistor, causing variation in $V_{BE}$ and regulator output voltage. Twenty to thirty millivolts per volt is typical regulation, inadequate for modern circuitry.

Thus, a need exists for an improved integrated voltage regulator circuit having an NPN shunt transistor for improving regulation and reducing chip size.

SUMMARY OF THE INVENTION

Accordingly, it is an object of the present invention to provide an improved integrated voltage regulator.

Another object of the present invention is to provide an integrated voltage regulator having an NPN shunt transistor.

In carrying out the above and other objects of the present invention in one form, there is provided an improved voltage regulator fabricated in monolithic integrated circuit form having a first supply voltage terminal, a second supply voltage terminal, and an output terminal. Means are coupled between the first and second supply voltage terminals for providing a regulated voltage at a node. Further means including an NPN transistor biased by a voltage divider are coupled between the node and the first supply voltage terminal for further regulating the voltage at the node.

The above and other objects, features, and advantages of the present invention will be better understood from the following detailed description taken in conjunction with the accompanying drawing.

DETAILED DESCRIPTION OF THE DRAWINGS

Figure 1:
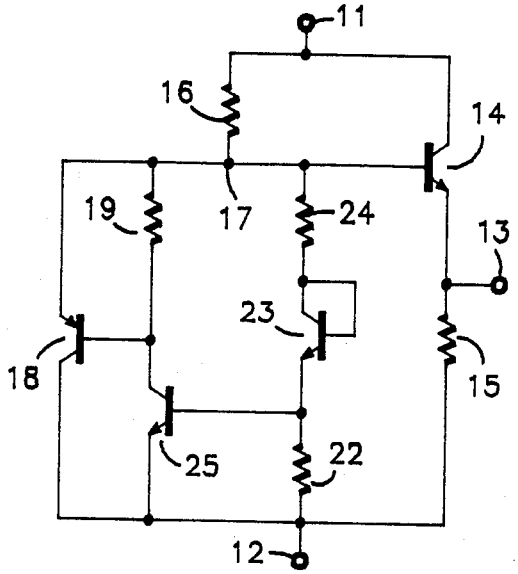
FIG. 1 illustrates in schematic form a prior art voltage regulator.

Referring to FIG. 1, a previously known $nV_{BE}$ type voltage regulator is shown that includes supply voltage terminals 11 and and output terminal 13. Supply voltage terminal 12 would be at a voltage below that of supply voltage terminal 11, and typically would be ground. Emitter follower transistor 14 has a collector connected to supply voltage terminal 11 and an emitter connected to output terminal 13 for providing an output signal thereto. Resistor 15 is coupled between output terminal 13 and supply voltage terminal 12 for stabilizing the output current of transistor 14. Resistor 16 is coupled between supply voltage terminal 11 and node 17 and serves as the load resistance for the regulator.

PNP transistor 18 has an emitter connected to node 17, a collector connected to supply voltage terminal 12, and a base coupled to node 17 by resistor 19. Transistor 25 has a collector connected to the base of transistor 18 and an emitter connected to supply voltage terminal 12. Transistor 18 is biased in order to remove excess current from node 17 as the voltage on supply voltage terminal 11 rises above an undesired level. The base of transistor 25 is coupled to supply voltage terminal 12 by resistor 22. Diode connected transistor 23 has an emitter connected to the base of transistor 25, and its collector and base coupled to node 17 by resistor 24.

The special feature of the regulator in FIG. 1 is the PNP shunt transistor 18. Variations in power supply voltage cause variations in current through resistor 16. Transistor 18 is intended to shunt these variations in current around the reference voltage diode, the base-emitter junction of transistor 25, permitting the reference voltage across resistor 22 to remain substantially constant over variations in power supply voltage, thus improving voltage regulation.

The PNP shunt circuit has not been very effective, however, because of the inherent device limitations of both available types of PNP transistor. The lateral PNP transistor has low current gain and so its high base current passes through transistor 25 causing variations in the reference voltage, degrading voltage regulation. The vertical PNP transistor is formed by using the grounded wafer substrate for the collector. While the vertical PNP has reasonable current gain, it must pass large currents through the substrate to ground tending to cause the substrate to pump up. Extra substrate contacts are then necessary to prevent substrate pump up. Additionally, both types require large chip area.

Figure 2:
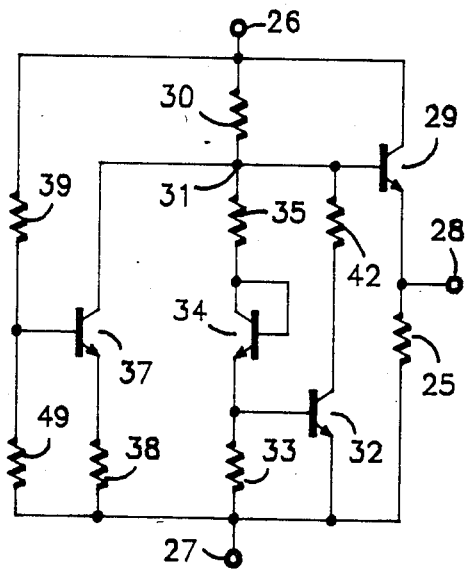
FIG. 2 illustrates in schematic form a preferred embodiment of the present invention.

Referring to FIG. 2, the voltage regulator of the present invention is shown which may be fabricated in monolithic integrated circuit form and comprises supply voltage terminals 26 and 27 and output terminal 28. Supply voltage terminal 27 would be at a voltage below that of supply voltage terminal 26, and typically would be ground. Emitter follower transistor 29 has a collector connected to supply voltage terminal 26, an emitter connected to output terminal 28, and a base connected to node 31. Resistor 25 is coupled between output terminal 28 and supply voltage terminal 27 for stabilizing the output current of transistor 29. Resistor 30 is coupled between supply voltage terminal 26 and node 31 to serve as the load resistance for the regulator.

Transistor 32 has a collector coupled to node 31 by resistor 42, an emitter connected to supply voltage terminal 27, and a base coupled to supply voltage terminal 27 by resistor 33. Diode connected transistor 34 has an emitter connected to the base of transistor 32, and its base and collector coupled to node 31 by resistor 35.

Transistor 37 has a collector connected to node 31, an emitter coupled to supply voltage terminal 27 by resistor 38, and a base coupled to supply voltage terminal 26 by resistor 39 and to supply voltage terminal 27 by resistor 49.

Resistors 39 and 49 serve as a voltage divider for biasing transistor 37. As the voltage on supply voltage terminal 26 increases, there will occur an increase in current through resistor 30. The values of resistors 38,39 and 49 are so chosen that the increase in supply voltage will cause the current through transistor 37 to increase by precisely the same amount as the current through resistor 30 increased. Consequently, all the other branch currents from node 31 must remain constant. Thus the voltage on node 31, and therefore, the output voltage of the regulator will remain essentially constant over changes in power supply voltage.

The advantages of the present invention are seen from the the following analysis. Summing currents at node 31 gives $$I_{37} = \frac{V_{cc} - V_{31}}{R_{30}} - I_{35} - I_{42} - I_{b}29$$

where $I_{37}$=current through transistor 37,
$I_{35}$=current through resistor 35,
$I_{42}$=current through resistor 42,
$V_{CC}$=voltage at terminal 11,
$V_{31}$=voltage at node 31,
$R_{30}$=resistance of resistor 30.
$I_{b29}$=base current of transistor 29.

For perfect regulation over changes in power supply voltage $I_{34}$, $I_{32}$, $I_{b29}$, and $V_{31}$ are constant and therefore permits solution for the functional form that $I_{37}$ must take in order to achieve perfect regulation. Taking the derivative of equation (1), $$\frac{d(I_{37})}{d(V_{cc})} = \frac{1}{R_{30}} \tag{2}$$

and integrating equation (2) gives $$I_{37} = \frac{1}{R_{30}} V_{cc} + C,$$

where C is a constant whose value can be determined from the DC operating point of the regulator. Thus, $$C = -\left(\frac{V_{31}}{R_{30}} + I_{35} + I_{42} + I_{b29}\right).$$

Thus for perfect regulation, $I_{37}(V_{cc})$ must be of the form $$I_{37} = \frac{1}{R_{30}} V_{cc} + C. \tag{3}$$

The actual value of $I_{37}$ is determined by the NPN shunt network consisting of restors 38, 39, and 49 and transitor 37. Assuming beta of transistor 37 is reasonably high, $$I_{37} = \frac{R_{41}}{(R_{39} + R_{49})(R_{38})} V_{cc} - \frac{V_{BE37}}{R_{38}} \quad (4)$$

where $R_{38}$=resistance of resistor 38,
$R_{39}$=resistance of resistor 39,
$R_{41}$=resistance of resistor 41,
$R_{42}$=resistance of resistor 42,
$V_{BE37}$=base-emitter voltage of transistor 37, Equations (3) and (4) are of the same form if $V_{BE37}$ is considered to be constant. In fact $V_{BE37}$ is a slowly varying log function of $V_{cc}$ and for accurate calculations, $V_{BE37}$ can be closely approximated by a linear approximation function $V_{BE37}(V_{cc})$ can then be added to the respective terms in equation (4) without changing its linear form. So to simplify this analysis, $V_{BE37}$ will simply be considered a constant whose value is known.

Equating like terms of equations (3) and (4) gives the solution for the design values of resistors 38, 39, and 49.

$$\frac{V_{BE37}}{R_{38}} = -C \quad (5)$$

$$\frac{R_{41}}{(R_{39} + R_{41})(R_{38})} = \frac{1}{R_{30}} \quad (6)$$

From equation (5)

$$R_{38} = \frac{V_{BE37}}{\frac{V_{31}}{R_{30}} + I_{35} + I_{42} + I_b29}$$

$$\frac{R_{41}}{(R_{39} + R_{41})} = \frac{R_{38}}{R_{30}}$$

Notice that only the ratio of $R_{41}$ to $(R_{41}+R_{39})$ is of interest. Their absolute values are so chosen that the base current of transistor 37 does not affect the above analysis. The main process dependence is the value of $R_{38}$, which is generally well controlled. Designs using the linear approximation for $V_{BE37}$ have simulated regulation at less than 10 mV per volt over the commercial power supply voltage and temperature range, nearly a three-to-one improvement over the state-of-the art.

By now it should be appreciated that there has been provided an improved voltage regulator circuit having an NPN shunt transistor. The improved voltage regulator retains the desirable temperature and diode ratioing characteristics of an $nV_{BE}$ regulator yet has the added benefit of excellent voltage regulations over power supply voltage variations. Additionally, the benefit of good regulation is had without the disadvantages of large chip area and device limitations associated with a PNP transistor.

I claim:

1. A circuit for providing a regulated output voltage having a first supply voltage terminal, a second supply voltage terminal, and an output terminal, comprising:

a first resistor coupled between a node and said first supply voltage terminal first means coupled between said node and said second supply voltage terminals for providing a regulated voltage at said node;

second means coupled between said first and second supply voltage terminals, and coupled to said node for providing said regulated output voltage at said output terminal;

a first NPN transistor having a collector coupled to said node;

a second resistor coupled between an emitter of said first NPN transistor and said second supply voltage terminal; and a first voltage divider coupled between said first and second supply voltage terminals and to a base of said first NPN transistor for biasing said first NPN transistor.

2. The circuit according to claim 1 wherein said first voltage divider comprises:

a third resistor coupled between said first supply voltage terminal and said base of said first NPN transistor; and fourth resistor coupled between said base of said first NPN transistor and said second supply voltage terminal.

3. The circuit according to claim 2 where said first means comprises a second NPN transistor having an emitter coupled to said second supply voltage terminal and a collector coupled to said node, and a second voltage divider coupled between said node and said second supply voltage terminal and coupled to a base of said second NPN transistor for biasing said second NPN transistor.

* * * * *